US009090069B2

(12) United States Patent
Togashi

(10) Patent No.: US 9,090,069 B2
(45) Date of Patent: Jul. 28, 2015

(54) LIQUID EJECTING HEAD, LIQUID EJECTING HEAD UNIT, AND LIQUID EJECTING APPARATUS

(71) Applicant: SEIKO EPSON CORPORATION, Tokyo (JP)

(72) Inventor: Isamu Togashi, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/553,860

(22) Filed: Nov. 25, 2014

(65) Prior Publication Data

US 2015/0158301 A1 Jun. 11, 2015

(30) Foreign Application Priority Data

Dec. 6, 2013 (JP) ..... 2013-253531

(51) Int. Cl.
*B41J 2/165* (2006.01)

(52) U.S. Cl.
CPC ..... *B41J 2/16511* (2013.01)

(58) Field of Classification Search
CPC .... B41J 2/16511; B41J 2/165; B41J 2/16505; B41J 2/16547; B41J 2/16544
See application file for complete search history.

(56) References Cited

U.S. PATENT DOCUMENTS 5,798,777 A * 8/1998 Yoshimura et al. ..... 347/29
2008/0174640 A1 7/2008 Okazawa

FOREIGN PATENT DOCUMENTS

| | | |
|---|---|---|
| JP | 2007-283552 | 11/2007 |
| JP | 2008-179050 | 8/2008 |
| JP | 2011-131484 | 7/2011 |
| JP | 2011-240624 | 12/2011 |

* cited by examiner

*Primary Examiner* — Juanita D Jackson
(74) *Attorney, Agent, or Firm* — Workman Nydegger

(57) ABSTRACT

There is provided a liquid-ejecting head including: a fixing board which can abut against a cap for a liquid-ejecting surface at a ring-shaped abutting area; and a driving element for ejecting liquid via nozzle openings provided on the liquid-ejecting surface. The fixing board has an acute-angle portion and an obtuse-angle portion. The abutting area includes: a pair of first-curved parts corresponding to the acute-angle portion; a pair of second-curved parts corresponding to the obtuse-angle portion; and a plurality of straight-line parts which can connect the two curved parts. On the liquid-ejecting surface, among a first-intersection point on virtual lines extended from each of the two straight-line parts connected the first-curved part and a second-intersection point on virtual lines extended from each of the two straight-line parts connected to the second-curved part, the fixing board has reference holes positioned nearer to the first-intersection point than the second-intersection point.

20 Claims, 10 Drawing Sheets

LIQUID EJECTING HEAD, LIQUID EJECTING HEAD UNIT, AND LIQUID EJECTING APPARATUS

CROSS REFERENCES TO RELATED APPLICATIONS

This application claims priority to Japanese Patent Application No. 2013-253531 filed on Dec. 6, 2013. The entire disclosure of Japanese Patent Application No. 2013-253531 is hereby incorporated herein by reference.

BACKGROUND

1. Technical Field

The present invention relates to a liquid ejecting head which ejects liquid from nozzle openings, liquid ejecting head unit which includes the liquid ejecting head, and a liquid ejecting apparatus, and particularly relates to an ink jet type recording head which ejects ink as the liquid, an ink jet type recording head unit, and an ink jet type recording apparatus.

2. Related Art

An ink jet type recording head which is an example of a liquid ejecting head includes a fixing board, such as a cover head, which is provided on a liquid ejecting surface side, a head main body (hereinafter, referred to as a chip) which is stacked in a direction perpendicular to the liquid ejecting surface, and a maintaining portion which is adhered to a side opposite to a liquid ejecting surface of the head main body. For example, the cover head as the fixing board includes a window frame portion having an opening window portion which exposes nozzle openings provided on an ink droplet ejecting surface side of the ink jet type recording head, and a sidewall portion which is formed to be bent to a side of the side surface of the ink jet type recording head from the window frame portion. The sidewall portion is fixed by bonding to the side surface of the ink jet type recording head.

In order to position the fixing board and the chip in a case of assembling the liquid ejecting head, or to position the fixing board and the chip between the liquid ejecting heads in a case of establishing and unitizing the plurality of liquid ejecting heads, reference holes are provided on the fixing board, for example, through holes are formed at four corners of a nozzle plate which is a fixing board together with the cover head (for example, refer to JP-A-2008-179050).

The reference holes of the fixing board had to be determined by considering at least one of conditions, such as being at a position where liquid is unlikely to be accumulated by wiping the liquid ejecting surface, or being at a position where a gap is not generated by abutting against a rib of a cap at a time of capping operation. Therefore, in a long line head, when the reference holes are provided at the four corners of the rectangular fixing board as described above, there is a problem in that the fixing board, a wiper, and the entire head becomes large.

In addition, the problem exists not only in the ink jet type recording head, but also similarly in the liquid ejecting head unit which ejects liquid other than the ink.

SUMMARY

An advantage of some aspects of the invention is to provide a liquid ejecting head, a liquid ejecting head unit, and a liquid ejecting apparatus, which decreases the size as much as possible without inconvenience, at least, in the capping operation.

According to an aspect of the invention, there is provided a liquid ejecting head including: a fixing board which can abut against a rib of a cap with respect to a liquid ejecting surface at a ring-shaped abutting area; and a driving element for ejecting liquid via nozzle openings provided on the liquid ejecting surface. The cap relatively moves with respect to the liquid ejecting surface. The fixing board is in a shape having an acute angle portion and an obtuse angle portion. When viewed from a direction perpendicular to the fixing board, the abutting area includes: a pair of first curved parts corresponding to the acute angle portion; a pair of second curved parts corresponding to the obtuse angle portion; and a plurality of straight line parts which can connect two curved parts among the pair of first curved parts and the pair of second curved parts. At an outer side of the abutting area in the liquid ejecting surface, among a first intersection point on virtual lines which extend each of the two straight line parts that is connected to the first curved part and a second intersection point on virtual lines which extend each of the two straight line parts that is connected to the second curved part, the fixing board has reference holes at a position which is nearer to the first intersection point than the second intersection point.

According to the aspect, when the reference holes are provided at the outer side of the abutting area of the rib of the cap, since a space which is greater than the pair of second curved parts corresponding to the obtuse angle portion at the outer side of the pair of first curved parts corresponding to the acute angle portion remains, the reference holes can be disposed at a position which is nearer to the first intersection point than the second intersection point among the intersection points on the virtual line which extends each of the two straight parts that is connected to each of the curved parts without enlarging the fixing board itself due to the provided reference holes. In addition, since the reference hole is at the outer side of the abutting area against the rib of the cap, it is possible to prevent ink from being accumulated in the reference holes like in the case where the reference holes are provided at the inner side of the abutting area, without generating a gap at a time of capping. In addition, the plurality of straight line parts includes the straight line part which connects the first curved part and the second curved part, the straight line part which connects the two first curved parts, and the straight line part which connects the two second curved parts.

Here, it is preferable that the first curved part have a less absolute value of a curvature than the second curved part. Accordingly, a stress applied to the first curved part corresponding to the acute angle portion can be dispersed, and irregularity of the stress to the ring-shaped rib can be mitigated. For this reason, it is possible to ensure sealing of the cap. In addition, it is possible to leave a space which is greater than the obtuse angle side at the outer side of the acute angle side, and to effectively dispose the reference holes.

In addition, it is preferable that the fixing board have a plurality of abutting areas, and the reference holes be provided between the plurality of abutting areas. Accordingly, it is possible to dispose the reference holes between the plurality of abutting areas, and to effectively dispose the reference holes without making the fixing board long.

In addition, it is preferable that the reference holes be provided nearer to the acute angle portion of the fixing board than the obtuse angle portion of the fixing board. According to this, it is possible to dispose the reference holes nearer to the acute angle portion, and to effectively dispose the reference holes without making the fixing board long. In addition, since the reference holes can be provided in the vicinity, it is possible to reduce a possibility of deformation or position shift caused by a bending process even at a time of the bending process of an outer circumferential portion of the fixing board.

In addition, in a direction perpendicular to a movement direction when a wiper relatively moves with respect to the fixing board among in-plane directions of the fixing board, it is preferable that the reference holes be disposed at the outer side of an area provided with the plurality of nozzle openings. According to this, even when the liquid is accumulated in the reference holes, since the reference holes are at the outer side of the nozzle openings in a direction perpendicular to a second direction, it is possible to reduce a possibility that the ink accumulated in the reference holes is wiped by the wiper and moves to the nozzle openings.

In addition, in a direction perpendicular to the movement direction when the wiper relatively moves with respect to the fixing board among the in-plane directions of the fixing board, it is preferable that the reference holes be positioned at the outer side of the abutting area. According to this, the liquid is likely to remain in the abutting area against the rib of the fixing board, but since the reference holes are at the outer side of the abutting area against the rib in the direction perpendicular to the second direction, it is possible to reduce a possibility that the liquid wiped by the wiper is accumulated in the reference holes.

According to another aspect of the invention, there is provided a liquid ejecting head unit including: the above-described liquid ejecting head; and a fixing substrate which maintains the plurality of liquid ejecting heads provided in parallel in a reference direction, in the in-plane directions of the liquid ejecting surface.

According to the aspect, by providing the plurality of liquid ejecting heads in parallel in which the reference holes are disposed without making the fixing board itself large, it is possible to realize a long line head for decreasing the size. In addition, since the reference holes are at the outer side of the abutting area against the rib of the cap, it is possible to prevent the ink from being accumulated in the reference holes like in the case where the reference holes are provided at the inner side of the abutting area without generating the gap at a time of capping. Even in a case of wiping in a direction in which the liquid ejecting heads are provided in parallel, the wiping to the nozzle openings is not affected even if the liquid is accumulated in the reference holes.

In addition, according to another aspect of the invention, there is provided a liquid ejecting apparatus including the above-described liquid ejecting head.

According to the aspect, it is possible to realize the liquid ejecting apparatus provided with the liquid ejecting head for making the size small. In addition, since the reference holes are at the outer side of the abutting area against the rib of the cap, it is possible to prevent the ink from being accumulated in the reference holes like in the case where the reference holes are provided at an inner side of the abutting area without generating the gap at a time of capping.

Furthermore, according to another aspect of the invention, there is provided a liquid ejecting apparatus including the above-described liquid ejecting head unit.

According to the aspect, it is possible to realize the liquid ejecting apparatus provided with the liquid ejecting head unit for making the size small. In addition, since the reference holes are at the outer side of the abutting area against the rib of the cap, it is possible to prevent the ink from being accumulated in the reference holes like in the case where the reference holes are provided at the inner side of the abutting area without generating the gap at a time of capping.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, the invention will be described in detail based on embodiments.

Embodiment 1

Figure 1:
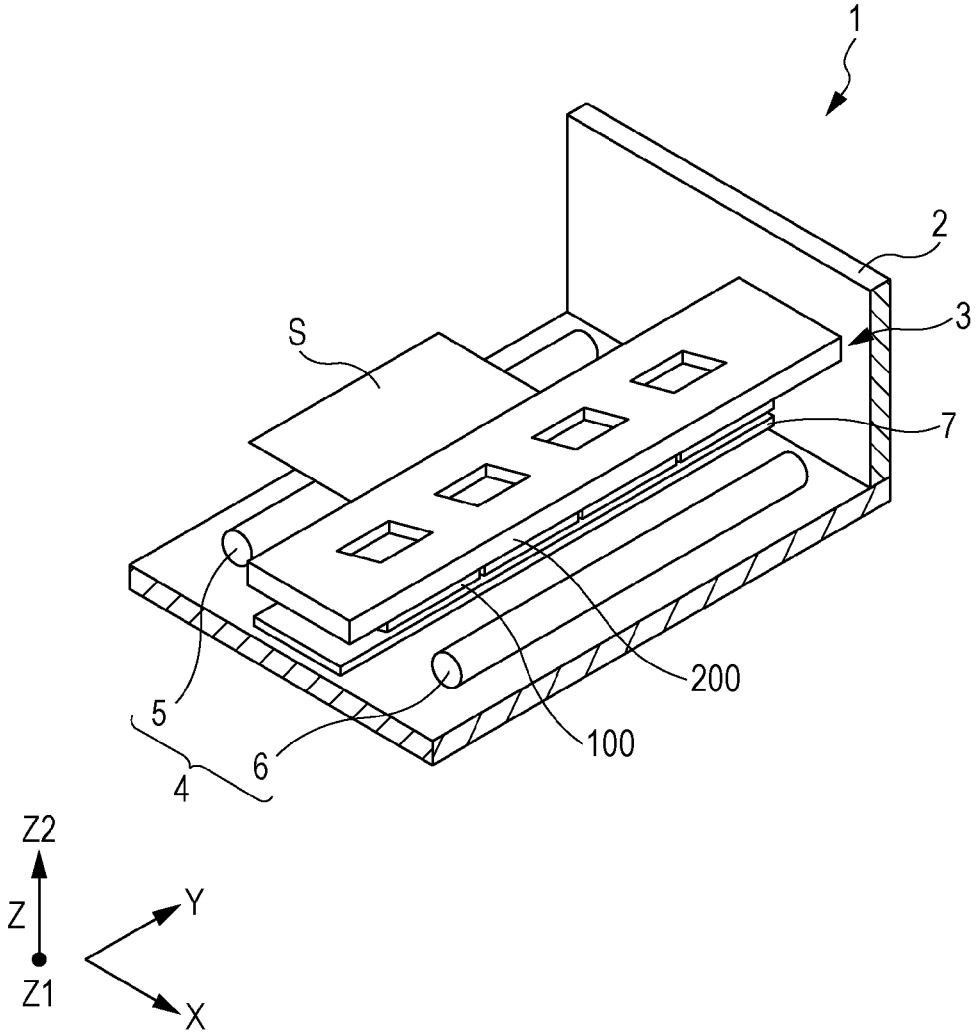
FIG. 1 is a schematic perspective view of a recording apparatus according to Embodiment 1 of the invention.

FIG. 1 is a schematic perspective view of a configuration of an ink jet type recording apparatus which is an example of a liquid ejecting apparatus according to Embodiment 1 of the invention.

The ink jet type recording apparatus which is an example of the liquid ejecting apparatus of the embodiment is a so-called line type recording apparatus in which an ink jet type recording head unit which is an example of a liquid ejecting head unit is fixed and printing is performed by transporting a recording sheet, such as a paper sheet, which is an ejecting medium.

In particular, as illustrated in FIG. 1, an ink jet type recording apparatus 1 includes: an apparatus main body 2; an ink jet type recording head unit 3 (hereinafter, simply referred to as a head unit 3) which has a plurality of ink jet type recording heads 100 and is fixed to the apparatus main body 2; a transporting section 4 which transports a recording sheet S; and a supporting member 7 which supports the recording sheet S facing the head unit 3. In addition, in the embodiment, a transporting direction of the recording sheet S is called a first direction X. In addition, in in-plane directions in which nozzle openings of the head unit 3 are opened, a direction perpendicular to the first direction X is called a second direction Y. Furthermore, a direction perpendicular to the first direction X and the second direction Y is called a third direction Z. In addition, a liquid ejecting direction side (recording sheet S side) on the surface including the third direction Z is called a Z1 side, and an opposite side is called a Z2 side.

The head unit 3 includes a plurality of ink jet type recording heads 100 and a head fixing substrate 200 which maintains the plurality of ink jet type recording heads 100.

The plurality of ink jet type recording heads 100 is provided in parallel in the second direction Y and fixed to the head fixing substrate 200. In addition, in the embodiment, the plurality of ink jet type recording heads 100 is provided in parallel on a straight line of the second direction Y. In other words, the plurality of ink jet type recording heads 100 is not disposed to be shifted to the first direction X. Accordingly, it is possible to narrow a width of the head unit 3 in the first direction X, and to make the head unit 3 small.

In addition, the head fixing substrate 200 maintains the plurality of ink jet type recording heads 100 so that nozzle openings 21 of the plurality of ink jet type recording heads 100 face the recording sheet S side, and is fixed to the apparatus main body 2.

The transporting section 4 transports the recording sheet S in the first direction X with respect to the head unit 3. The transporting section 4 includes, for example, a first transporting roller 5 and a second transporting roller 6 which are provided at both sides in the first direction X that is the transporting direction of the recording sheet S with respect to the head unit 3.

By the first transporting roller 5 and the second transporting roller 6, the recording sheet S is transported. In addition, the transporting section 4 which transports the recording sheet S is not limited to a transporting roller, but may be a belt, a drum, or the like.

The supporting member 7 supports the recording sheet S transported by the transporting section 4 at a position facing the head unit 3. The supporting member 7 is, for example, made of a metal or resin, in which a cross section provided facing the head unit 3 is rectangular between the first transporting roller 5 and the second transporting roller 6.

In addition, in the supporting member 7, an adsorbing section which adsorbs the transported recording sheet S onto the supporting member 7 is provided. Examples of the adsorbing section include a section which sucks and adsorbs by sucking the recording sheet S and a section which electrostatically adsorbs the recording sheet S by an electrostatic force. For example, when the transporting section 4 is a belt or a drum, the supporting member 7 supports the recording sheet S on the belt or the drum at the position facing the head unit 3.

In addition, a liquid storage section (not illustrated), such as an ink tank or an ink cartridge in which the ink is stored, is connected to each of the ink jet type recording heads 100 of the head unit 3 to be able to supply the ink. The liquid storage section, for example, may be maintained on the head unit 3, or may be maintained at a position different from the head unit 3 in the apparatus main body 2. In addition, a flow path for supplying the ink supplied from the liquid storage section to the ink jet type recording head 100, or the like, may be provided inside the head fixing substrate 200, and a flow path member may be provided in addition to the head fixing substrate 200 and the ink from the liquid storage section may be supplied via the flow path member to the ink jet type recording head 100. Obviously, the ink may be supplied directly to the ink jet type recording head 100 without using the head fixing substrate 200 or the flow path member fixed to the head fixing substrate 200 from the liquid storage section.

In the ink jet type recording apparatus 1, the recording sheet S is transported by the first transporting roller 5, and the printing is performed on the recording sheet S supported on the supporting member 7 by the head unit 3. The printed recording sheet S is transported by the second transporting roller 6.

Figure 2:
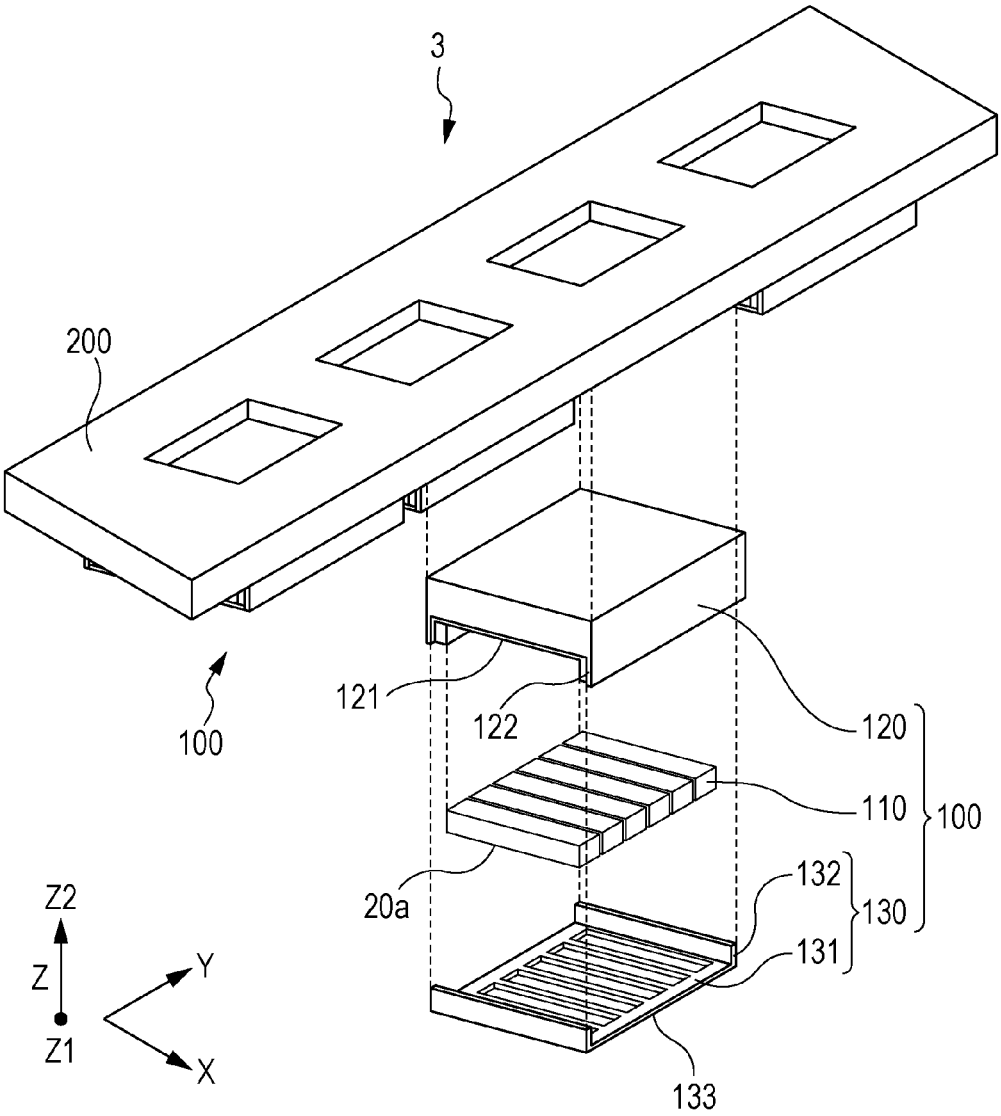
FIG. 2 is an exploded perspective view of a head unit according to Embodiment 1 of the invention.
Figure 3:
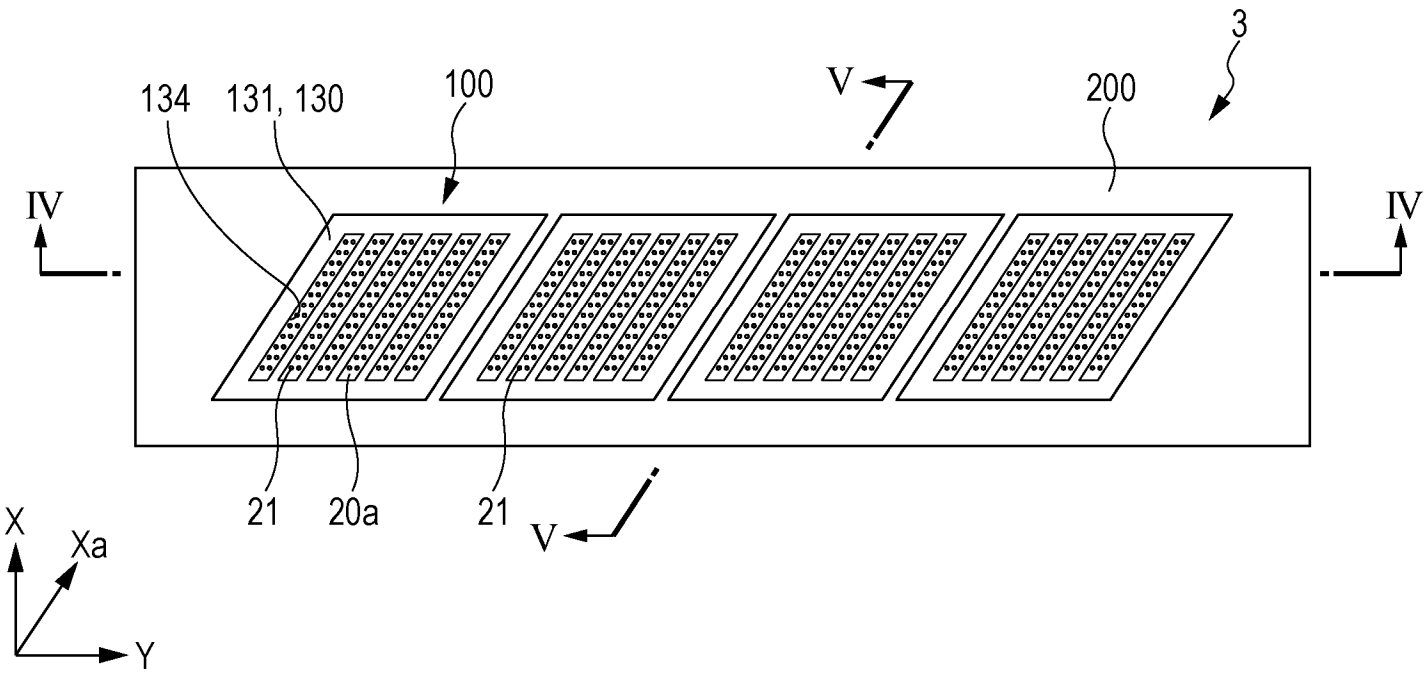
FIG. 3 is a plan view of the head unit according to Embodiment 1 of the invention.
Figure 4A:
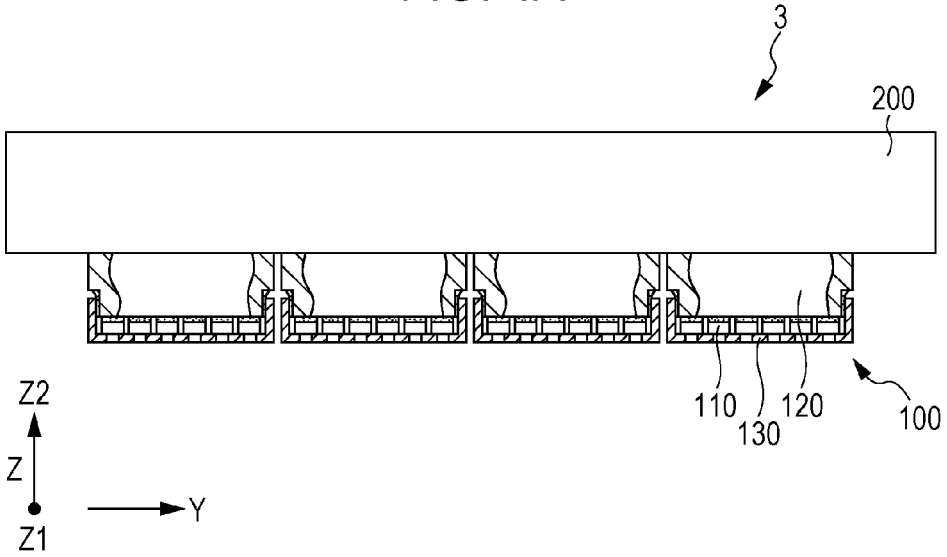
FIGS. 4A and 4B are a cross-sectional view and an enlarged view of the head unit according to Embodiment 1 of the invention.
Figure 4B:
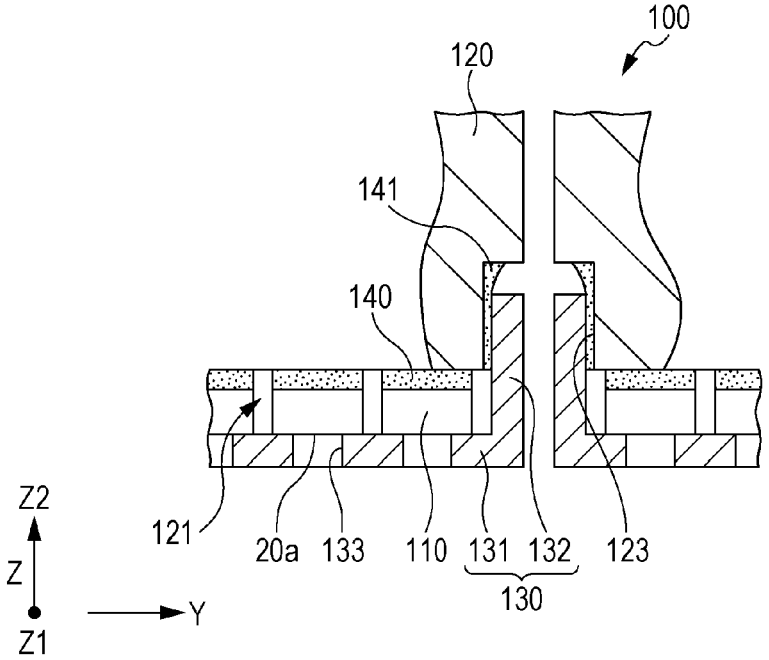
Figure 5:
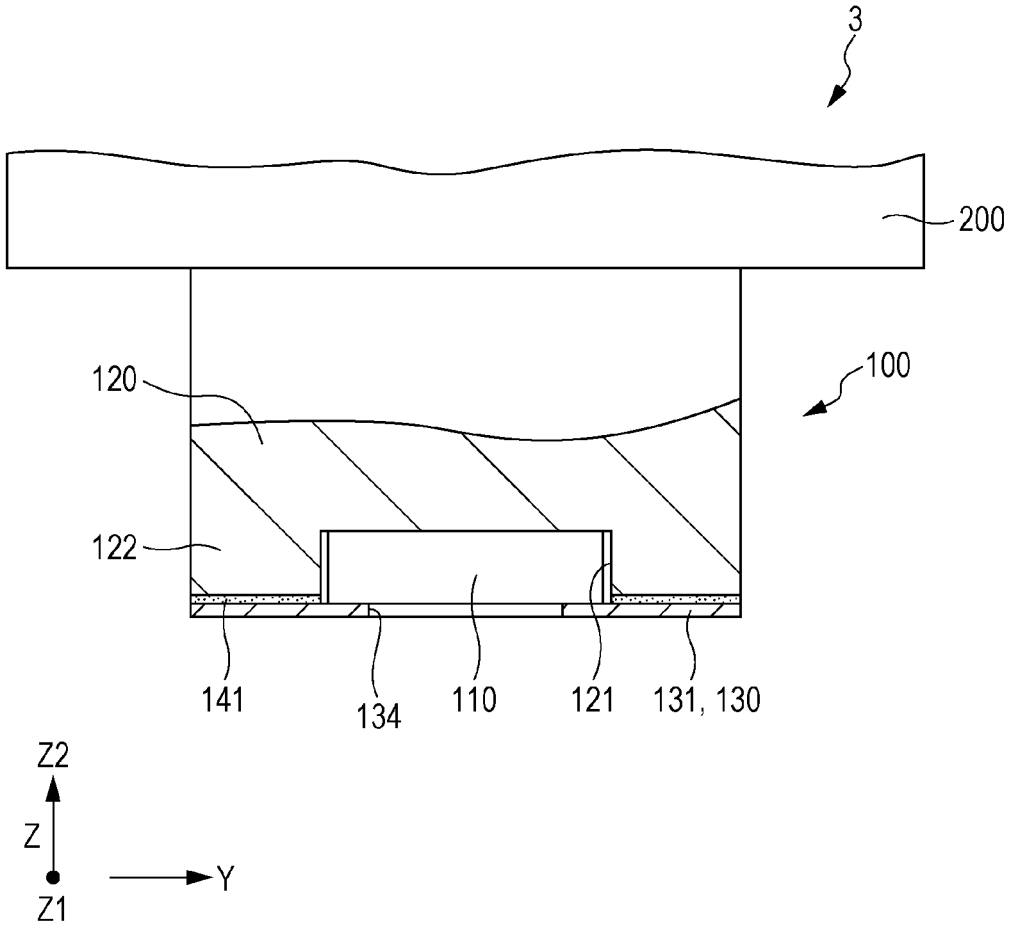
FIG. 5 is a cross-sectional view of the head unit according to Embodiment 1 of the invention.

Here, the head unit 3 which is mounted on the ink jet type recording apparatus 1 will be further described in detail with reference to FIGS. 2 to 5. In addition, FIG. 2 is an exploded perspective view illustrating the ink jet type recording head unit which is an example of the liquid ejecting head unit according to Embodiment 1 of the invention. FIG. 3 is a plan view of the liquid ejecting surface side of the ink jet type recording head unit. FIGS. 4A and 4B are a cross-sectional view which cuts out a main part along line IIIA-IIIA in FIG. 3 and an enlarged view of the main part, respectively. FIG. 5 is a cross-sectional view which cuts out the main part along line IIIB-IIIB in FIG. 3.

As illustrated in the drawings, the head unit 3 of the embodiment includes the plurality of ink jet type recording heads 100 and the head fixing substrate 200 which maintains the plurality of ink jet type recording heads 100.

The ink jet type recording head 100 has a liquid ejecting surface 20*a* provided with a nozzle opening 21 at the Z1 side of the third direction Z.

The ink jet type recording head 100 is fixed at the surface side facing the recording sheet S of the head fixing substrate 200, that is, the Z1 side which is the recording sheet S side of the third direction Z.

As described above, the plurality of ink jet type recording heads 100 is fixed to the head fixing substrate 200 provided in parallel on the straight line in the second direction Y perpendicular to the first direction X which is the transporting direction. In other words, the plurality of ink jet type recording heads 100 is not disposed to be shifted in the first direction X. Accordingly, it is possible to narrow the width of the head unit 3 in the first direction X, and to make the head unit 3 small. Obviously, the ink jet type recording heads 100 provided in parallel in the second direction Y may be disposed to be shifted in the first direction X, but when the ink jet type recording head 100 is largely shifted in the first direction X, the width of the head fixing substrate 200 or the like in the first direction X increases. In this manner, when the size of the head unit 3 in the first direction X becomes large, a distance between the first transporting roller 5 and the second transporting roller 6 in the first direction X in the ink jet type recording apparatus 1 increases, and it is difficult to fix the posture of the recording sheet S. In addition, the size of the head unit 3 and the ink jet type recording apparatus 1 becomes large.

In addition, in the embodiment, the four ink jet type recording heads 100 are fixed to the head fixing substrate 200. However, if the number of the ink jet type recording heads 100 is two or more, the number is not particularly limited.

Here, an example of the ink jet type recording head mounted on the head unit will be described in detail.

As illustrated in the drawings, the ink jet type recording head 100 includes: a plurality of head main bodies 110; a holder 120 which is a maintaining member of the embodiment that maintains the plurality of head main bodies 110; and a cover 130 provided at the liquid ejecting surface 20*a* side of the head main body 110.

The head main body 110 has the liquid ejecting surface 20*a* provided with the nozzle opening 21 at the Z1 side of the third direction Z. In addition, a Z2 side of the plurality of head main bodies 110 is adhered to a surface of the Z1 side of the holder 120.

The holder 120 has a maintaining portion 121 which forms a space in a groove shape at the Z1 side. As the maintaining portion 121 is provided to be continued across the second direction Y on the surface of the Z1 side of the holder 120, the maintaining portion 121 is provided to be opened on both side surfaces of the second direction Y. In addition, in the holder 120, as the maintaining portion 121 is provided at a substantial center part of the first direction X, leg portions 122 are formed at both sides of the maintaining portion 121 in the first direction X. In other words, the leg portions 122 are provided only at both end portions in the first direction X on the surface of the Z1 side of the holder 120, and are not provided at both end portions in the second direction Y.

The plurality of head main bodies 110 is adhered to the inside of the maintaining portion 121 by an adhesive 140. In other words, the leg portions 122 are disposed at both sides in the third direction Z with respect to the head main body 110. In addition, a surface of the holder 120 and a surface of the head main body 110 which are facing each other in the third direction Z are adhered to each other by the adhesive 140. In addition, in the inside (not illustrated) of the holder 120, the flow path or the like which supplies the ink to the head main body 110 is provided, and a flow path of the holder 120 and a flow path of the head main body 110 communicate with each other to be sealed by the adhesive 140. In addition, the holder 120 may have a configuration in which a plurality of members is stacked in the third direction Z.

Here, the head main body 110, which will be described later in detail, has a configuration in which the plurality of members is stacked. In the plurality of head main bodies 110, irregularity in height in the third direction Z occurs according to dimensional tolerance of the plurality of members which constitutes each of the head main bodies 110 and irregularity in thickness of the adhesive or the like which stacks the plurality of members. In order to maintain the plurality of head main bodies 110 in which the irregularity in height in the third direction Z occurs by the common holder 120 and to arrange the liquid ejecting surface 20*a* of the plurality of head main bodies 110 on a plane surface, that is, in order to arrange the height of the liquid ejecting surface 20*a* in the third direction Z, it is required to accommodate the irregularity in height of the head main bodies 110 by the adhesive 140 which adheres the holder 120 and the head main bodies 110 to each other. In this manner, it is preferable that an adhesive having relatively high viscosity be used as the adhesive 140 which accommodates the irregularity in height of the head main bodies 110. Even when the adhesive 140 is an adhesive having relatively high viscosity, there is a problem in that the moisture included in the ink evaporates from the adhesive 140 which adheres the holder 120 and the head main bodies 110 to each other. Even when only one head main body 110 is provided, there is a concern that the moisture included in the ink evaporates from the adhesive 140 which adheres the head main body 110 and the holder 120 to each other. In other words, even when the irregularity in height is not accommodated by the adhesive 140 which adheres the head main body 110 and the holder 120 to each other, there is a concern that the moisture evaporates from the adhesive 140 which adheres the head main body 110 and the holder 120 to each other.

It can be also considered to fix the holder 120 and the head main body 110 with a screw or the like. However, the size of the head main body 110 is small, and in the embodiment, since the plurality of the head main bodies 110 is required to be attached with respect to one holder 120, it is difficult to fix the head main body 110 with a screw or the like via a seal member made of an elastic material. Therefore, by adhering the head main body 110 and the holder 120 to each other by the adhesive 140, it is possible to lower the cost by reducing the number of components and to seal the flow path which is connected to both of the head main body 110 and the holder 120 without providing the seal member or the like made of the elastic material therebetween.

In addition, the plurality of head main bodies 110 is adhered to the inside of the maintaining portion 121 of the holder 120 to be provided in parallel in the second direction Y. In the embodiment, six head main bodies 110 are adhered to the holder 120. The number of the head main bodies 110 fixed to one holder 120 is not limited to the above-described number. The number of the head main body 110 with respect to one holder 120 may be one, or may be two or more. By providing the plurality of head main bodies 110 with respect to one ink jet type recording head 100 and making a plurality of nozzle rows, it is possible to improve yield, compared to a case where the plurality of nozzle rows are provided only to one head main body 110 with respect to one ink jet type recording head 100. In other words, by making the plurality of nozzle rows in one head main body 110, the yield of the head main body 110 decreases and the manufacturing cost increases. In contrast to this, by fixing the plurality of head main bodies 110 to the common holder 120 and making the plurality of nozzle rows by the plurality of head main bodies 110, it is possible to improve the yield of the head main body 110 and to reduce the manufacturing cost.

In addition, the plurality of head main bodies 110 of the embodiment is fixed so that the nozzle rows are inclined with respect to the first direction X which is the transporting direction of the recording sheet S, in the in-plane directions of the liquid ejecting surface 20*a*. In other words, with respect to the first direction X, a fourth direction Xa, which is a parallel direction of the nozzle openings 21 that constitutes the nozzle row, is inclined. In the embodiment, in the ink jet type recording head 100, the plurality of head main bodies 110 is provided in parallel in the second direction Y, and the ink jet type recording head 100 can be disposed at a position where at least parts of the nozzle openings 21 of the adjacent head main bodies 110 in the second direction Y are overlapped with each other in the first direction X. In addition, the plurality of ink jet type recording heads 100 is provided in parallel in the second direction Y, and can be disposed at a position where at least parts of the nozzle openings 21 of the adjacent head main bodies 110 in the second direction Y are overlapped with each other in the first direction X. Accordingly, it is possible to form the nozzle openings 21 which are provided in parallel at a similar interval in the second direction Y of the head unit 3.

The cover 130 corresponds to a fixing board of the embodiment, and is made of a board-shaped member, such as a metal. The cover 130 is provided at the liquid ejecting surface 20*a* side of the ink jet type recording head 100, that is, at the Z1 side of the third direction Z of the ink jet type recording head 100.

The cover 130 is formed by bending a member in a flat board shape, and includes a base portion 131 provided at the liquid ejecting surface 20*a* side and a bending portion 132 in which both end portions of the base portion 131 in the second direction Y are provided to be curved to the Z2 side of the third direction Z. In the embodiment, since the bending portion is not provided in the vicinity of both ends of the first direction X, it is possible to consider the entire vicinity of both ends of the second direction Y of the base portion 131 as the bending portion 132, and an edge portion does not exist. Meanwhile, the entire vicinity of both ends of the first direction X is an edge portion 133.

As illustrated in FIG. 5, the base portion 131 is bonded to the surface of the Z1 side of the holder 120 in the third direction Z, that is, to an end surface of the Z1 side of the leg portions 122 via an adhesive 141.

In addition, an exposure opening portion 134 for opening the nozzle openings 21 of each of the head main bodies 110 is provided in the base portion 131. In the embodiment, the exposure opening portion 134 is provided to be independently opened for every head main body 110. In other words, as illustrated in FIGS. 4A and 4B, since the ink jet type recording head 100 of the embodiment has six head main bodies 110, six independent exposure opening portion 134 are provided in the base portion 131. According to the configuration of the head main body 110 or the like, one common exposure opening portion 134 may be provided with respect to a head main body group which is configured to have the plurality of head main bodies 110.

In addition, in the embodiment, since the leg portions 122 are not provided in the maintaining portion 121 in the second direction Y, the exposure opening portion 134 is provided to the vicinity of the bending portion 132 in the second direction Y. In other words, the interval from the entire circumference of the base portion 131 to the exposure opening portion 134 becomes smaller in the second direction Y than in the first direction X.

The Z1 side of the maintaining portion 121 of the holder 120 is covered by the base portion 131.

In addition, the bending portion 132 is provided at both end portions of the base portion 131 in the second direction Y, and is formed at a size that can cover the area of the opening which is opened to the side surface of the maintaining portion 121 in the second direction Y. In other words, the bending portion 132 is an area from the end portion of the base portion 131 in the second direction Y to an edge portion of the cover 130. The bending portion 132 is bonded to the side surface of the holder 120 in the second direction Y via the adhesive 141. Accordingly, the opening to the side surface of the maintaining portion 121 in the second direction Y is sealed to be covered by the bending portion 132.

In other words, between the holder 120 and the cover 130, the end surface of the leg portions 122 in the third direction Z and the base portion 131 are adhered to each other by the adhesive 141 at both sides of the first direction X, and the opened side surface of the maintaining portion 121 and the bending portion 132 are adhered to each other at both sides of the second direction Y via the adhesive 141. Accordingly, the head main body 110 is disposed in the maintaining portion 121 which is the space between the holder 120 and the cover 130. In other words, the adhesive 140 which adheres the head main body 110 and the holder 120 to each other is included in the maintaining portion 121 which is the space formed by adhering the holder 120 and the cover 130 by the adhesive 141. Therefore, even when the adhesive 140 is likely to allow permeation of the moisture included in the ink as the adhesive 140 which adheres the holder 120 and the head main body 110 to each other, since the inside of the maintaining portion 121 is sealed by the adhesive 141 which adheres the holder 120 and the cover 130, it is possible to suppress the evaporation of the moisture included in the ink. In addition, in order to seal the inside of the maintaining portion 121, it is preferable to adhere the base portion 131 of the cover 130 and the liquid ejecting surface 20*a* side of the head main body 110 to each other. In other words, it is appropriate that the vicinity of the exposure opening portion 134 is adhered to the head main body 110 so that the moisture does not evaporate to the outside via the exposure opening portion 134. In addition, it is appropriate that the adhesive 141, which adheres the holder 120 and the cover 130 to each other, adheres the holder 120 and the head main body 110, and is unlikely to allow permeation of the moisture rather than the adhesive 140 which accommodates the irregularity in height of the head main body 110.

In this manner, in the embodiment, at both sides of the holder 120 in the second direction Y, by providing the bending portion 132 in the cover 130, the cover 130 and the holder 120 are adhered to each other. Accordingly, at both sides of the holder 120 in the second direction Y, the leg portions to be adhered to the base portion 131 of the cover 130 are not required. For this reason, when the ink jet type recording head 100 is provided in parallel in the second direction Y, the leg portions do not exist at a side between the adjacent ink jet type recording heads 100. Therefore, it is possible to narrow the interval between the adjacent ink jet type recording heads 100 in the second direction Y. Accordingly, it is possible to provide the head main bodies 110 of the adjacent ink jet type recording heads 100 to be close to each other in the second direction Y, and to provide the nozzle openings 21 provided in each of the head main bodies 110 of the adjacent ink jet type recording heads to be close to each other in the second direction Y.

In order to suppress evaporation of the moisture included in the ink without providing the bending portion 132 which is adhered to the holder 120 at both sides of the cover 130 in the second direction Y, it is required to provide the leg portions at both sides of the holder 120 in the second direction Y, and to adhere the end surface of the Z1 side of the leg portions and the base portion 131 to each other. In other words, it is required to provide the maintaining portion 121 to be opened only to the Z1 side of the third direction Z. In this manner, when the leg portions are provided at both sides of the second direction Y, the interval between the maintaining portions 121 of the adjacent ink jet type recording heads 100 widens, and it is not possible to provide the head main bodies 110 of the adjacent ink jet type recording heads 100 to be close to each other, and thus, the nozzle openings 21 are disposed to be separated in the second direction Y. In other words, in order to provide the ink jet type recording heads 100 adjacent to each other and to provide the head main bodies 110 of the ink jet type recording heads 100 to be close to each other, the leg portions 122 may not be provided at both sides of the second direction Y which is the direction in which the ink jet type recording heads 100 are provided in parallel. Here, the maintaining portion 121 is provided with the opening, which communicates with the space where the head main bodies 110 are disposed, at both side surfaces of the second direction Y. In addition, in the configuration, when the cover 130 adheres only to the end surface of the Z1 side of the leg portions 122 of the holder 120, the inside of the maintaining portion 121 is opened to the outside on both side surfaces of the second direction Y, and the moisture which permeates the adhesive 140 that adheres the holder 120 and the head main bodies 110 to each other evaporates to the outside.

In the embodiment, by sealing the maintaining portion 121 which is opened to both side surfaces of the second direction Y for providing the head main bodies 110 to be close to each other by the bending portion 132 of the cover 130, without providing the leg portions at both sides of the second direction Y, it is possible to narrow the interval of the adjacent ink jet type recording heads 100 in the second direction Y, to provide the nozzle openings 21 of the adjacent ink jet type recording heads 100 to be close to each other, and to suppress evaporation of the moisture which permeates the adhesive 140 that adheres the head main bodies 110 and the holder 120 to each other.

In addition, in the embodiment, a concave portion 123 is provided on the side surface of the holder 120 in the second direction Y, and the bending portion 132 is adhered to the inside of the concave portion 123. The concave portion 123 is provided to be opened to both side surfaces of the second direction Y and to be opened to the surface of the Z1 side in the third direction Z. As the concave portion 123 is provided in the holder 120, the bending portion 132 is inserted and adhered to the inside of the concave portion 123. For this reason, it is possible to easily adhere the holder 120 and the bending portion 132 of the cover 130 to each other. In other words, by providing the concave portion 123 in the holder 120, a space between the holder 120 and the bending portion 132 of the cover 130 is filled with the adhesive 141 by a capillary force only by coating the adhesive 141 between the end portion of the bending portion 132 of the cover 130, which is inserted into the concave portion 123, and the concave portion 123. For this reason, it is not required to perform a process in which the adhesive 141 is coated from a direction which faces a different direction along the end portion of the bending portion 132 with respect to a gap between the holder 120 and the bending portion 132 without the concave portion 123, and thus it is possible to simplify the adhesion process. In addition, in the embodiment, by providing the concave portion 123 in the holder 120, a protrusion amount of the bending portion 132 of the cover 130 in the second direction Y can be small, the interval of the adjacent ink jet type recording heads 100 in the second direction Y can further narrow, and the interval of the nozzle openings 21 of the adjacent ink jet type recording heads 100 can further narrow. In addition, by providing the concave portion 123 in the holder 120 and inserting the bending portion 132 into the concave portion 123, even when an irregularity in bending angle of the bending portion 132 occurs, it is possible to make the protrusion amount of the bending portion 132 in the second direction Y small. For this reason, it is possible to suppress interference of the bending portion 132 in the adjacent ink jet type recording heads 100. Accordingly, it is possible to narrow the interval between the ink jet type recording heads 100 adjacent to each other.

In this manner, in the head unit 3 of the embodiment, when the plurality of ink jet type recording heads 100 which suppresses evaporation of the moisture of the ink is provided in parallel in the head fixing substrate 200 in the second direction Y, it is possible to narrow the interval between the ink jet type recording heads 100 adjacent to each other in the second direction Y. For this reason, it is possible to narrow the interval of the nozzle openings 21 of the adjacent ink jet type recording heads 100. In addition, since the interval of the nozzle openings 21 of the adjacent ink jet type recording heads 100 can narrow, it is possible to provide the plurality of ink jet type recording heads 100 in parallel on the straight line which extends in the second direction Y, and to make the width of the head unit 3 in the first direction X small.

In the embodiment, since the width of the head unit 3 in the first direction X can be small, it is possible to shorten the distance between the first transporting roller 5 and the second transporting roller 6 in the first direction X, to make it easy to fix the posture of the recording sheet S, and to improve the printing quality. In addition, it is possible to make the head unit 3 and the ink jet type recording apparatus 1 small.

As illustrated in FIG. 3, when viewed from the liquid ejecting surface 20*a* side in a planar view, the ink jet type recording head 100 of the embodiment has a shape which is a substantial parallelogram. As described above, this is because the fourth direction Xa, which is a direction in which the nozzle openings 21 that constitute the nozzle rows of each of the head main bodies 110 are provided in parallel, is provided to be inclined with respect to the first direction X which is the transporting direction of the recording sheet S, and an external shape of the ink jet type recording head 100 is formed to be a substantial parallelogram in the fourth direction Xa which is the direction in which the nozzle rows are inclined. The shape when viewed from the liquid ejecting surface 20*a* side of the ink jet type recording head 100 in a planar view is not limited to the substantial parallelogram, and the shape may be rectangular, trapezoidal, or polygonal.

By disposing and considering the plurality of ink jet type recording heads 100 as the ink jet type recording head unit, effects, such as improved yield in manufacturing, easy process, or easy flattening of the plane surface of the cover 130 which is the fixing board, can be achieved.

In addition, in the embodiment, the leg portions 122 are provided at both sides of the holder 120 in the first direction X, but the leg portions 122 may not be provided. In other words, the head main body 110 may be adhered to the surface of the Z1 side of the holder 120, and the bending portion 132 may be provided at both sides of the cover 130 in the first direction X and the second direction Y. In other words, in the cover 130, the bending portion 132 may be provided across the entire circumference in the in-plane directions of the liquid ejecting surface 20*a*, and the cover 130 may be adhered across the entire circumference of the side surface of the holder 120. Accordingly, it is possible to make the width of the head unit 3 in the first direction X much smaller. In addition, by making the width of the head unit 3 in the first direction X small, it is possible to provide the plurality of head units 3 to be close to each other in the first direction X. However, the cover 130 which has the bending portion 132 across the entire circumference of the base portion 131 requires to be formed by a drawing process. However, in the drawing process, there is a case where the length of the bending portion 132 is not sufficiently ensured and manufacturing is difficult. In addition, as illustrated in the embodiment, by adhering the end surface of the Z1 side of the leg portions 122 to the base portion 131 of the cover 130, it is possible to improve strength of the ink jet type recording heads 100 in the third direction Z. In addition, by adhering the end surface of the Z1 side of the leg portions 122 to the base portion 131 of the cover 130, it is possible to support the pressure at a time of adhering the cover 130 and the holder 120 to each other by the leg portions 122, and to suppress a destruction of the head main body 110 or the like by suppressing the pressure directly applied to the head main body 110.

In addition, in the embodiment, the leg portions 122 are not provided at both sides of the holder 120 in the second direction Y. However, by providing the leg portions 122 at both sides of the second direction Y, it is possible to improve strength of the ink jet type recording head 100 in the third direction Z. In this case, the length of the end surface of the Z1 side in the first direction X of the leg portions 122 provided at both sides of the first direction X is shorter than the length of the end surface of the Z1 side in the second direction Y of the leg portions 122 provided at both sides of the second direction Y. Accordingly, it is possible to narrow the interval of the ink jet type recording heads 100 adjacent to each other in the second direction Y. In addition, in this case, at both sides of the second direction Y, by adhering the bending portion 132 and the side surface of the holder 120 to each other by the adhesive 141, it is possible to ensure an area which is required to adhere the cover 130 on the side surface of the holder 120, and to effectively suppress evaporation of the moisture.

In addition, in the embodiment, both end portions of the base portion 131 in the first direction X are not curved toward the Z2 side, and the leg portions 122 are adhered to the base portion 131 at the liquid ejecting surface 20*a* side. The embodiment is not limited thereto, and for example, the bending portion may also be formed by leaving end portions of both ends of the second direction Y of both end portions of the base portion 131 in the first direction X as the edge portion.

Accordingly, as a corner of the ink jet type recording head 100 in the first direction X at the liquid ejecting surface 20*a* side is covered by the cover 130, it is possible to suppress a defect, such as peeling of the cover 130, due to the abutting recording sheet S.

Figure 6:
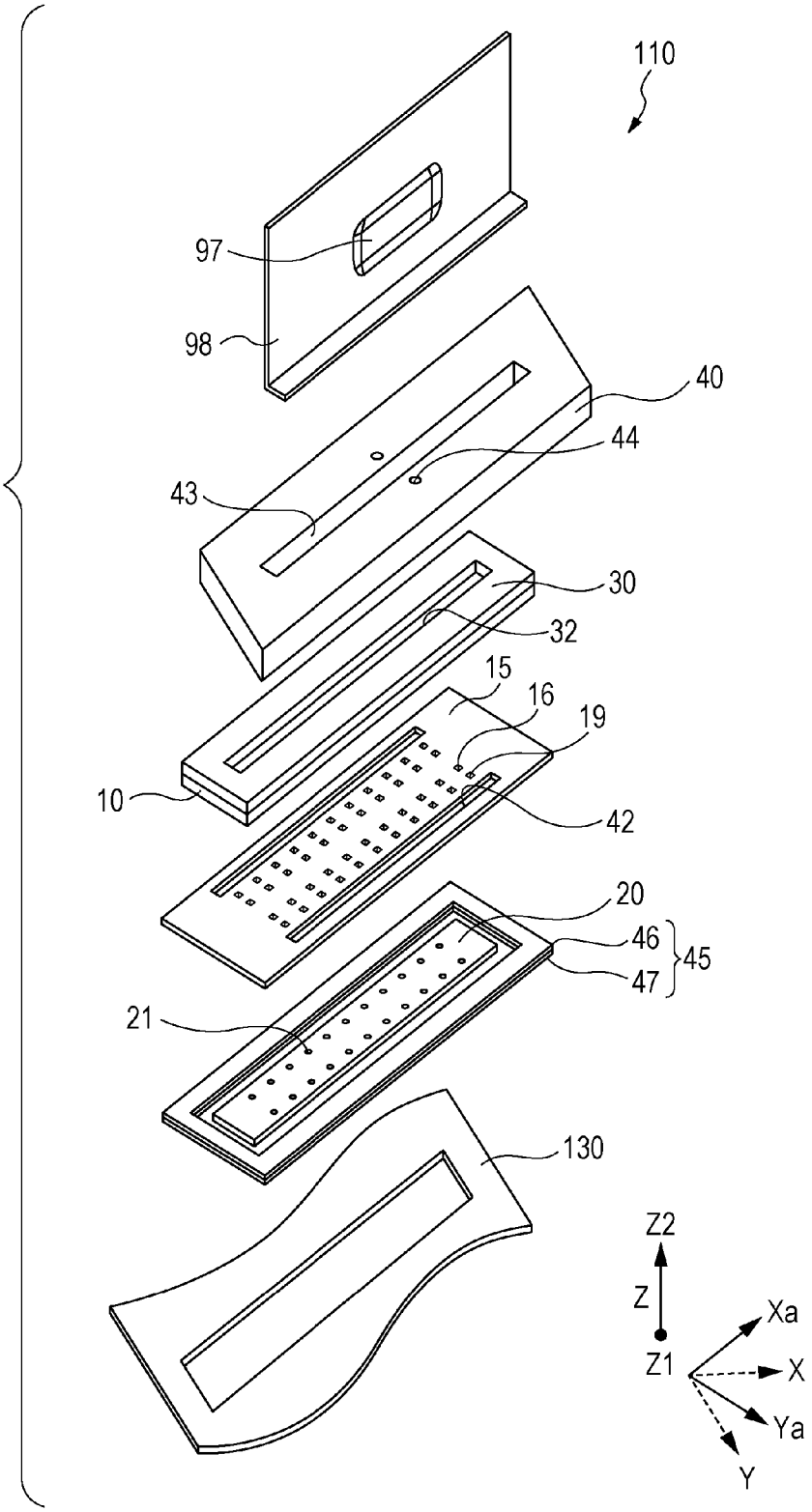
FIG. 6 is an exploded perspective view of a head main body according to Embodiment 1 of the invention.
Figure 7:
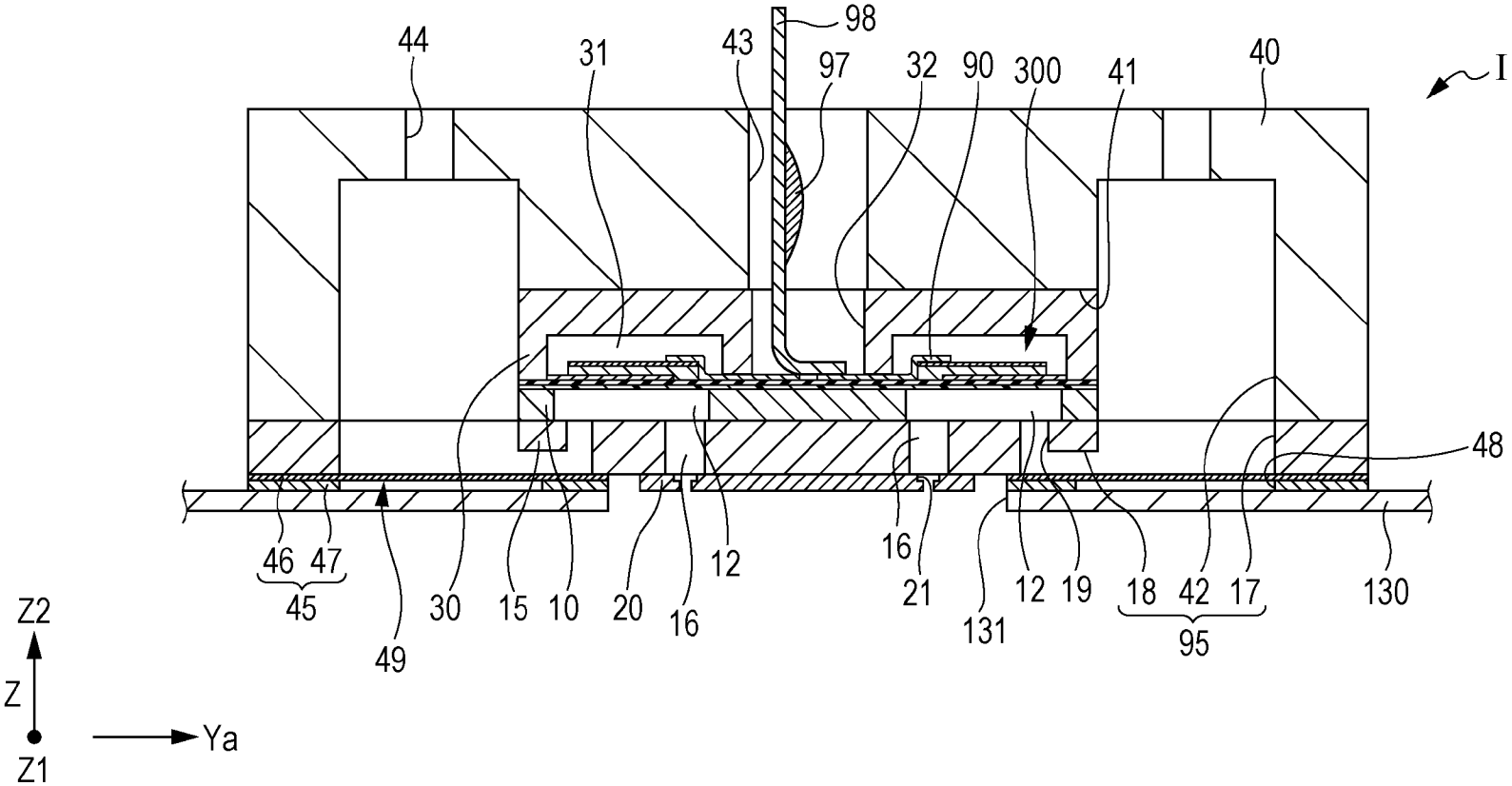
FIG. 7 is a cross-sectional view of the head main body according to Embodiment 1 of the invention.

Hereinafter, an example of the head main body 110 of the ink jet type recording head 100 of the above-described liquid ejecting apparatus will be described in detail, but the configuration of the head main body 110 is not limited to the configuration described below. FIG. 6 is a perspective view of the head main body according to Embodiment 1 of the invention. FIG. 7 is a cross-sectional view of the head main body in the second direction Y.

As illustrated in the drawings, the head main body 110 of the embodiment has the plurality of members, such as a flow path forming substrate 10, a communication board 15, a nozzle plate 20, a protection substrate 30, a compliance substrate 45, or a case 40, and the plurality of members are bonded by the adhesive or the like.

As illustrated in the drawings, by performing anisotropic etching from one surface side, on the flow path forming substrate 10 which constitutes the head main body 110, a pressure generation chamber 12 defined by a plurality of partitions is provided in parallel along the direction in which the plurality of nozzle openings 21 is provided in parallel. In addition, in the embodiment, the direction in which the pressure generation chambers 12 are provided in parallel matches with the fourth direction Xa, and on the flow path forming substrate 10, a plurality of rows, in the embodiment, two rows in which the pressure generation chambers 12 are provided in parallel in the fourth direction Xa are provided. The direction, in which the plurality of pressure generation chambers 12 rows formed by the pressure generation chambers 12 provided in the fourth direction Xa is provided, is called a fifth direction Ya, hereinafter. In addition, in the embodiment, the direction perpendicular to the fourth direction Xa and the fifth direction Ya matches with the third direction Z. In addition, the head main bodies 110 of the embodiment is mounted on the head unit 3 so that the fourth direction Xa in which the nozzle openings 21 are provided in parallel is a direction which is inclined with respect to the first direction X that is the transporting direction of the recording sheet S.

In addition, on the flow path forming substrate 10, at one end portion side of the pressure generation chamber 12 in the fifth direction Ya, the opening area may be smaller than the pressure generation chamber 12, and a supply path which imparts a flow path resistance of the ink which flows into the pressure generation chamber 12 or the like may be provided.

In addition, as illustrated in FIG. 6, the communication board 15 is bonded to one surface side of the flow path forming substrate 10. In addition, the nozzle plate 20, in which the plurality of nozzle openings 21 that communicates with each of the pressure generation chambers 12 is provided, is bonded to the communication board 15. In the embodiment, the Z1 side, which is one surface of the third direction Z in which the nozzle openings 21 of the nozzle plate 20 are opened, is the liquid ejecting surface 20*a*. In addition, the nozzle plate 20 may have a configuration in which the nozzle openings 21 are provided on a stainless steel (SUS) sheet, or in which a silicon substrate on which the nozzle openings 21 are provided is bonded to the stainless steel (SUS) sheet.

On the communication board 15, a nozzle communication path 16, which communicates with the pressure generation chambers 12 and the nozzle openings 21, is provided. The communication board 15 has an area greater than the flow path forming substrate 10, and the nozzle plate 20 has an area less than the flow path forming substrate 10. In this manner, by making the area of the nozzle plate 20 relatively small, it is possible to reduce the cost.

In addition, on the communication board 15, a first manifold portion 17 and a second manifold portion 18 which constitute a part of a manifold 95 are provided.

The first manifold portion 17 is provided to penetrate the communication board 15 in the third direction Z.

In addition, the second manifold portion 18 does not penetrate the communication board 15 in the third direction Z, and is provided in the middle of the third direction Z to be opened to the nozzle plate 20 side of the communication board 15.

Furthermore, on the communication board 15, a supply communication path 19, which communicates with one end portion of the pressure generation chamber 12 in the second direction Y, is independently provided for every pressure generation chamber 12. The supply communication path 19 communicates with the second manifold portion 18 and the pressure generation chamber 12.

On the nozzle plate 20, the nozzle openings 21 which communicate with each of the pressure generation chambers 12 via the nozzle communication path 16 are formed. In other words, in the nozzle openings 21, openings which eject the ink that is the same type of liquid are provided in parallel in the fourth direction Xa, and two rows in which the nozzle openings 21 are provided in parallel in the fourth direction Xa are formed in the fifth direction Ya.

Meanwhile, at a surface side opposite to the communication board 15 of the flow path forming substrate 10, a diaphragm is formed. In addition, on the diaphragm, by sequentially stacking a first electrode, a piezoelectric layer, and a second electrode, a piezoelectric actuator 300 which is a pressure generation section of the embodiment is configured. In general, any one electrode of the piezoelectric actuator 300 is a common electrode, and the other electrode and the piezoelectric layer are patterned for every pressure generation chamber 12.

In addition, the protection substrate 30 which has substantially the same size as the flow path forming substrate 10 is bonded to a surface of the piezoelectric actuator 300 side of the flow path forming substrate 10. The protection substrate 30 has a maintaining portion 31 which is a space for protecting the piezoelectric actuator 300. In addition, a through-hole 32 which penetrates in the third direction Z is provided on the protection substrate 30. An end portion of a lead electrode 90 derived from the electrode of the piezoelectric actuator 300 extends to be exposed to the inside of the through-hole 32, and the lead electrode and a wiring substrate 98 which has a driving circuit 97, such as a driving IC, mounted thereon are electrically connected to each other inside the through-hole 32.

In addition, the case 40, which defines the manifold 95 that communicates with the plurality of pressure generation chambers 12, is fixed to the protection substrate 30 and the communication board 15. The case 40 which has a shape which is substantially the same as the communication board 15 described above in a planar view, is bonded to the protection substrate 30, and is bonded even to the communication board 15 described above. In particular, the case 40 has a concave portion 41 which has a depth to accommodate the flow path forming substrate 10 at the protection substrate 30 side and the protection substrate 30. The concave portion 41 has an opening area which is wider than a surface which is bonded to the flow path forming substrate 10 of the protection substrate 30. An opening surface of the nozzle plate 20 side of the concave portion 41 in a state where the flow path forming substrate 10 or the like is accommodated in the concave portion 41, is sealed by the communication board 15. Accordingly, in the outer circumferential portion of the flow path forming substrate 10, a third manifold portion 42 is defined by the case 40, the flow path forming substrate 10, and the protection substrate 30. The manifold 95 of the embodiment is configured by the third manifold portion 42, and the first manifold portion 17 and the second manifold portion 18 which are provided on the communication board 15.

In addition, the compliance substrate 45 is provided on a surface on which the first manifold portion 17 and the second manifold portion 18 of the communication board 15 are opened. The compliance substrate 45 seals the opening of the first manifold portion 17 and the second manifold portion 18.

In the embodiment, the compliance substrate 45 has a sealing film 46 and a fixed substrate 47. The sealing film 46 is formed of a thin film having flexibility (for example, polyphenylene sulfide (PPS) or stainless steel (SUS)). In addition, the fixed substrate 47 is formed of a hard material, such as a metal including stainless steel (SUS). Since an area of the fixed substrate 47 facing the manifold 95 is made of an opening portion 48 which is completely removed in a thickness direction, one surface of the manifold 95 is a compliance portion 49 which is a flexible portion sealed only by the sealing film 46 having flexibility.

In addition, in the embodiment, the cover 130 which is a fixing board is adhered to a surface side opposite to the communication board 15 of the compliance substrate 45. In other words, the exposure opening portion 134 provided in the base portion 131 of the cover 130 has the opening area which is wider than the area of the nozzle plate 20, and exposes the liquid ejecting surface 20*a* of the nozzle plate 20 inside the exposure opening portion 134. The cover 130 is not limited thereto, and for example, the exposure opening portion 134 of the cover 130 may be the opening area which is smaller than an external shape of the nozzle plate 20, and the cover 130 may abut against or be adhered to the liquid ejecting surface 20*a* of the nozzle plate 20. Even when the exposure opening portion 134 of the cover 130 is the opening area which is smaller than the external shape of the nozzle plate 20, the cover 130 and the liquid ejecting surface 20*a* may be provided to be in contact with each other. In other words, a case where the cover 130 is provided at the liquid ejecting surface 20*a* side includes a case where the liquid ejecting surface 20*a* is not in contact or a case where the liquid ejecting surface 20*a* is in contact.

In addition, in the embodiment, the cover 130 is adhered to the fixed substrate 47 of the compliance substrate 45. Accordingly, it is possible to seal the maintaining portion 121 between the cover 130 and the holder 120 as described above, and to suppress evaporation of the moisture of the ink.

In addition, in the case 40, an introducing path 44 for supplying the ink to each of the manifolds 95 by communicating with the manifold 95 is provided. In addition, in the case 40, a connection port 43, which communicates with the through-hole 32 of the protection substrate 30 and in which the wiring substrate 98 is inserted, is provided.

In the head main body 110 having the configuration, when the ink is ejected, the ink is incorporated via the introducing path 44 from a storage section, and the inside of the flow path from the manifold 95 to the nozzle opening 21 is filled with the ink. After that, according to a signal from the driving circuit 97, by applying a voltage to each piezoelectric actuator 300 corresponding to the pressure generation chamber 12, the diaphragm together with the piezoelectric actuator 300 are flexurally deformed. Accordingly, the pressure inside the pressure generation chamber 12 increases, and the ink droplets are ejected from predetermined nozzle openings 21.

When the above-described head main body 110 is bonded to the cover 130, the cover 130 is disposed by positioning, and the head main body 110 is adhered with respect to the cover 130 one by one. However, the reference holes used in positioning at that time are provided at the liquid ejecting surface side of the cover 130. Here, the reference holes are disposed at a predetermined position in a relationship with the abutting area which abuts against the rib of the cap at a time of capping operation. Hereinafter, the abutting area will be described in detail, but the abutting area is illustrated as an area which matches with the shape of the rib of the cap. However, since the rib is elastically deformed and abuts against the cover 130, a real abutting area is slightly different from the shape of the rib, and there is a possibility that even the straight line portion is wound. However, the abutting area in this case matches with the shape of a base end portion (a part fixed to a rigid body) of the rib in the cap in a non-abutting state.

Figure 8:
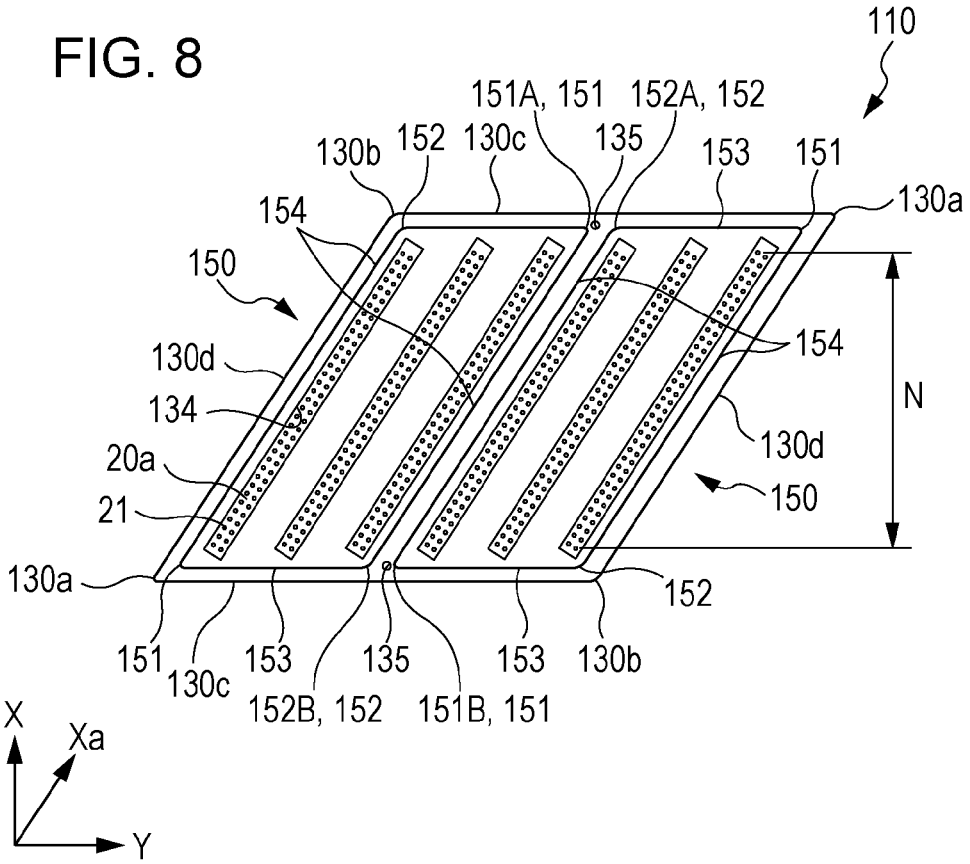
FIG. 8 is a plan view of the head unit from a liquid ejecting surface side according to Embodiment 1.
Figure 9:
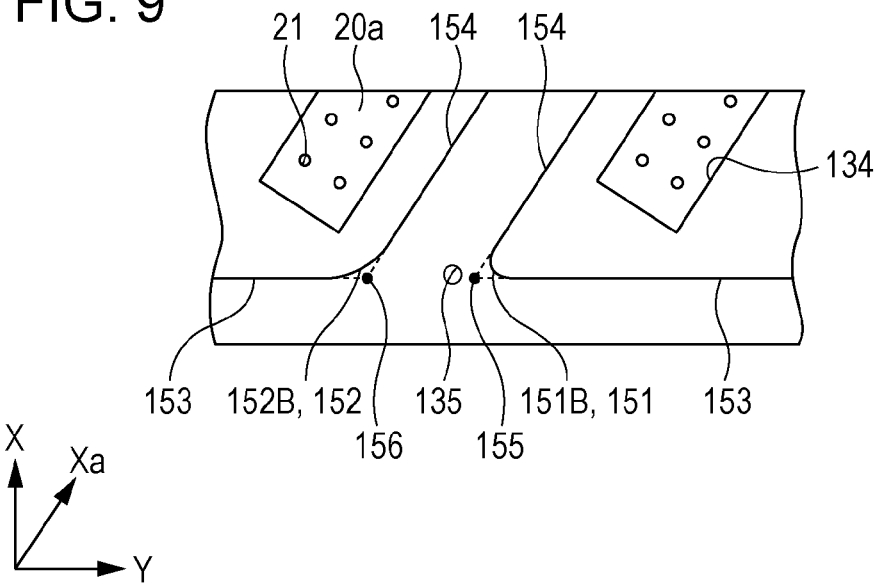
FIG. 9 is a partially enlarged view of FIG. 8.

FIG. 8 is a plan view when the ink jet type recording head 100 provided with the cover 130 is viewed from the liquid ejecting surface side. FIG. 9 is a partially enlarged view of FIG. 8. In the base portion 131 of the cover 130, six exposure opening portions 134 which are openings for exposing the rows of the nozzle openings 21 of the head main body 110 are provided, and two abutting areas 150 of the ring-shaped rib of the cap exist. In other words, the capping is performed by the two caps at the same, or the capping is performed alternately by one cap. Reference holes 135 for positioning will be described in detail hereinafter, but the reference holes 135 are provided near to the center of the side part of both ends of the first direction X between abutting areas 150 of the two caps.

The abutting area 150 has a ring shape similar to a parallelogram which is an external shape of the cover 130, and includes a pair of first curved parts 151, a pair of second curved parts 152, and a first straight line part 153 and a second straight line part 154 which connect the first curved parts 151 and the second curved parts 152. Here, the first straight line part 153 is along a side part 130*c* of the cover 130, and the second straight line part 154 is along a side part 130*d* of the cover 130. The abutting area 150 matches with the shape of the rib of the cap, and the area of the inner side of the abutting area 150 becomes a sealing space when the rib of the cap abuts. In the area in the cap, in reality, the communication opening or the nozzle openings exist, but the area in the cap is called a sealing space.

Here, the entire first curved parts 151 correspond to an acute angle portion 130*a* of the cover 130. In other words, in any one of a first curved part 151A (151) on the right-upper side of the abutting area 150 in the left side of the drawing and a first curved part 151B (151) on the left-below side of the abutting area 150 in the right side of the drawing, the abutting area 150 is considered to be similar to the external shape of the cover 130, and corresponds to the acute angle portion 130*a*. Meanwhile, similarly, the second curved parts 152 include second curved parts 152A and 152B, and any one of those corresponds to an obtuse angle portion 130*b* of the cover 130.

Among a first intersection point 155 which is at the outer side of the first curved part 151 of the abutting area 150 and which is on a virtual line which extends each of the first straight line part 153 and the second straight line part 154 that is connected to the first curved part 151, and a second intersection point 156 which is at the outer side of the second curved part 152 of the abutting area 150 and which is on a virtual line which extends each of the first straight line part 153 and the second straight line part 154 that is connected to the second curved part 152, the reference holes 135 are provided at a position which is nearer to the first intersection point 155 than the second intersection point 156 on an extending line of the first straight line part 153.

According to this, at a time of cap abutting, by providing the reference holes 135 at the outer side of the first curved part 151, not at the outer side of the second curved part 152, it is possible to effectively dispose the reference holes 135 without making the cover 130 large. In addition, since the reference holes 135 are provided at the outer side of the ring-shaped abutting area 150 which abuts against the rib, it is possible to prevent the gap from being generated in the sealing space like in the case where the reference holes are provide in the abutting area 150, and to prevent the ink from being accumulated in the reference holes like in the case where the reference holes are provide at the inner side of the abutting area.

In addition, as illustrated in FIG. 8, by providing the reference holes 135 in the side part 130*c* of the cover 130 which is between the two abutting areas 150, in the above-described embodiment, the bending portion is not provided in the side part 130*c*. However, even when the bending portion is provided, compared to a case where the corners (130*a*, 130*b*) of the cover 130 are provided, it is possible to reduce a possibility of the deformation or the position shift caused by the bending process.

In addition, not two abutting areas 150, but three or more abutting areas 150 may be provided. In a case where three abutting areas 150 are provided, two reference holes may be provided between any of the abutting areas 150, or reference holes may be provided one by one at one side and the other side in the first direction X between the abutting area 150.

In addition, as described above, in the embodiment, the reference holes 135 are positioned on the extending line of the first straight line part 153. However, in the first direction X, even when the reference holes 135 are positioned at the inner side on the extending line, if the reference holes 135 are disposed at a dimension which is less than the cover 130, the reference holes 135 may be provided at the outer side. However, when performing the wiping by the wiper by relatively moving in the second direction Y is considered, it is preferable that the reference holes 135 be provided at the outer side of a nozzle opening area N in which the nozzle openings 21 exist in the first direction X. Even when the liquid is accumulated in the reference holes 135, since the reference holes 135 are at the outer side of the nozzle opening area N in which the nozzle openings 21 exist in the first direction X, an effect of reducing a possibility that the liquid accumulated in the reference holes 135 is wiped by the wiper and moves to the nozzle openings 21 is achieved. In addition, even when the wiper is along the first direction X, the wiper may be along the fourth direction Xa.

In addition, when the wiping of the abutting area 150 is considered, it is preferable that the wiper be provided at the outer side of the abutting area 150 in the first direction X, that is, at the outer side of the extending line of the first straight line part 153. The liquid is likely to remain in the abutting area 150 abuts against the rib of the cover 130, but the reference holes 135 are at the outer side of the abutting area 150 in the first direction X. For this reason, an effect of reducing a possibility of the liquid which is wiped by the wiper and accumulated in the reference holes 135 is achieved.

Here, when the reference holes 135 are provided in the nozzle opening area N in the first direction X or at the outer side of the abutting area 150, it is preferable that the reference holes 135 be provided considering a winding distance of the wiper in the first direction X, which is assumed at a time of wiping operation. In the ink jet type recording head unit in which the plurality of ink jet type recording heads 100 are provided in parallel in the second direction Y, the wiper is likely to be wound in the first direction X, and in a case where the wiper is wound, when the reference holes 135 are interfered, the above-described effect cannot be obtained. However, by disposing the reference holes 135 at the outer side of the considered, it is possible to certainly obtain the above-described effect not only at an initiating position but also at an ending position of the relative movement of the wiper.

In addition, two reference holes 135 are provided in the vicinity of the side part 130*c* in the first direction X, but one reference hole 135 may be provided. When one reference hole 135 is provided, it is required to perform the positioning of an inclination by considering any one of the side part 130*c* of the cover 130 and the side part 130*d* of the second direction Y as a reference. By providing two reference holes 135 as described in the embodiment, it is possible to position with better accuracy including the inclination.

The reference holes 135 may be through holes which penetrate the cover 130, and may be a concave portion which does not penetrate. In the embodiment, by inserting a reference pin into the through hole, the positioning is performed.

In addition, the shape of the reference holes 135 is not particularly limited, and may be circular, elliptical, rectangular, or polygonal. In the embodiment, one reference hole is circular, and the other reference hole is elliptical.

As illustrated in FIG. 8, the first curved part 151 and the second curved part 152 of the abutting area 150 are arc-shaped, and an absolute value of a curvature of the first curved part 151 is less than an absolute value of a curvature of the second curved part 152. Accordingly, at a time of cap abutting, a stress applied to the first curved part 151 corresponding to the acute angle portion 130*a* can be dispersed, and irregularity of the stress of the ring-shaped rib can be mitigated. For this reason, it is possible to ensure sealing of the cap. In addition, it is possible to leave a space which is larger at the outer side of the first curved part 151 than at the outer side of the second curved part 152, and to effectively dispose the reference holes.

In addition, the first curved part 151 and the second curved part 152 may not be arc-shaped, and may be a polygonal shape or a C surface if the sealing is ensured at a time of capping.

Figure 10:
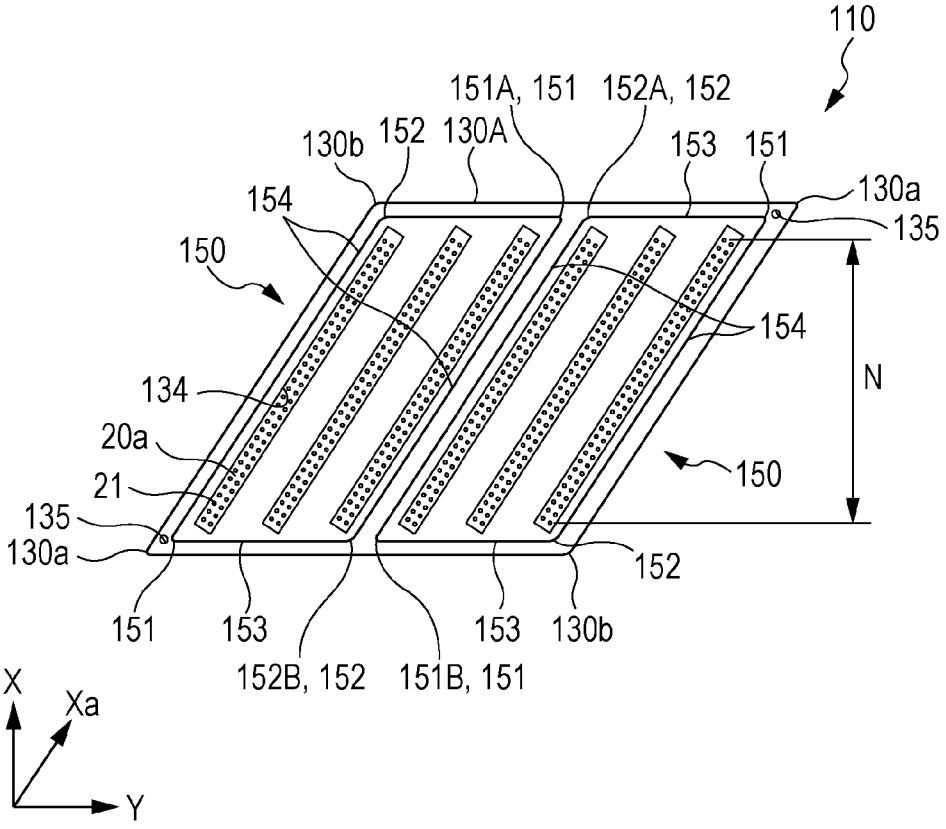
FIG. 10 is a plan view of a head unit from the liquid ejecting surface side of a modification example.

FIG. 10 is a plan view when an ink jet type recording head 100A provided with a cover 130A is viewed from the liquid ejecting surface side according to a modification example.

In FIG. 10, in the cover 130A, each of the reference holes 135 is provided in the vicinity of the acute angle portion 130*a* on a diagonal line. In this case, among the first intersection point 155 which is at the outer side of the first curved part 151 of the abutting area 150 and which is on the virtual line which extends each of the first straight line part 153 and the second straight line part 154 that is connected to the first curved part 151, and the second intersection point 156 which is at the outer side of the second curved part 152 of the abutting area 150 and which is on the virtual line which extends each of the first straight line part 153 and the second straight line part 154 that is connected to the second curved part 152, the reference holes 135 are provided at a position which is nearer to the first intersection point 155 than the second intersection point 156. In the modification example, an effect similar to the above-described embodiment is achieved, but since the reference holes reference holes 135 are provided on the greatest diagonal line, it is advantageous that the positioning of the inclination has more accuracy. In addition, in this case, the amount of abutting area 150 may be one, or may be three or more.

In this case, it is preferable that the reference holes 135 be provided at the outer side of the nozzle opening area N in the first direction X. In addition, it is further preferable as described above that the reference holes 135 be provided at the outer side of the abutting area 150.

Another Embodiment

Above, an embodiment of the invention is described, but a basic configuration of the invention is not limited to the description above.

For example, in the above-described Embodiment 1, since a fixing board provided at the liquid ejecting surface 20*a* side of the ink jet type recording head 100 may be provided at the liquid ejecting surface 20*a* side, the fixing board may not be provided to be protruded at the most liquid ejecting surface 20*a* side. In other words, in the above-described Embodiment 1, the liquid ejecting surface 20*a* of the nozzle plate 20 may be more protruded to the Z1 side than the cover 130. Furthermore, another member which is different from the nozzle plate 20 may be provided at the Z1 side rather than the fixing board at the liquid ejecting surface 20*a* side of the ink jet type recording head 100.

In addition, in the above-described Embodiment 1, the direction, in which the plurality of ink jet type recording heads 100 maintained in the head fixing substrate 200 is provided in parallel, is the second direction Y which is the direction perpendicular to the first direction X that is the transporting direction of the recording sheet S, but the invention is not limited thereto. The head unit, in which the ink jet type recording heads 100 are provided in parallel in a longitudinal direction of the head fixing substrate 200, may be disposed so that an angle in which an alignment direction of the plurality of ink jet type recording heads 100 intersects with the first direction X which is the transporting direction of the recording sheet S, that is, an angle which is smaller than 90 degrees with respect to the first direction X. At that time, in the in-plane directions of the liquid ejecting surface 20*a*, even when the nozzle rows are provided in a direction perpendicular the longitudinal direction of the head fixing substrate 200, by inclining the entire head unit, it is possible to dispose the nozzle rows inclined with respect to the first direction X which is the transporting direction.

Figure 11:
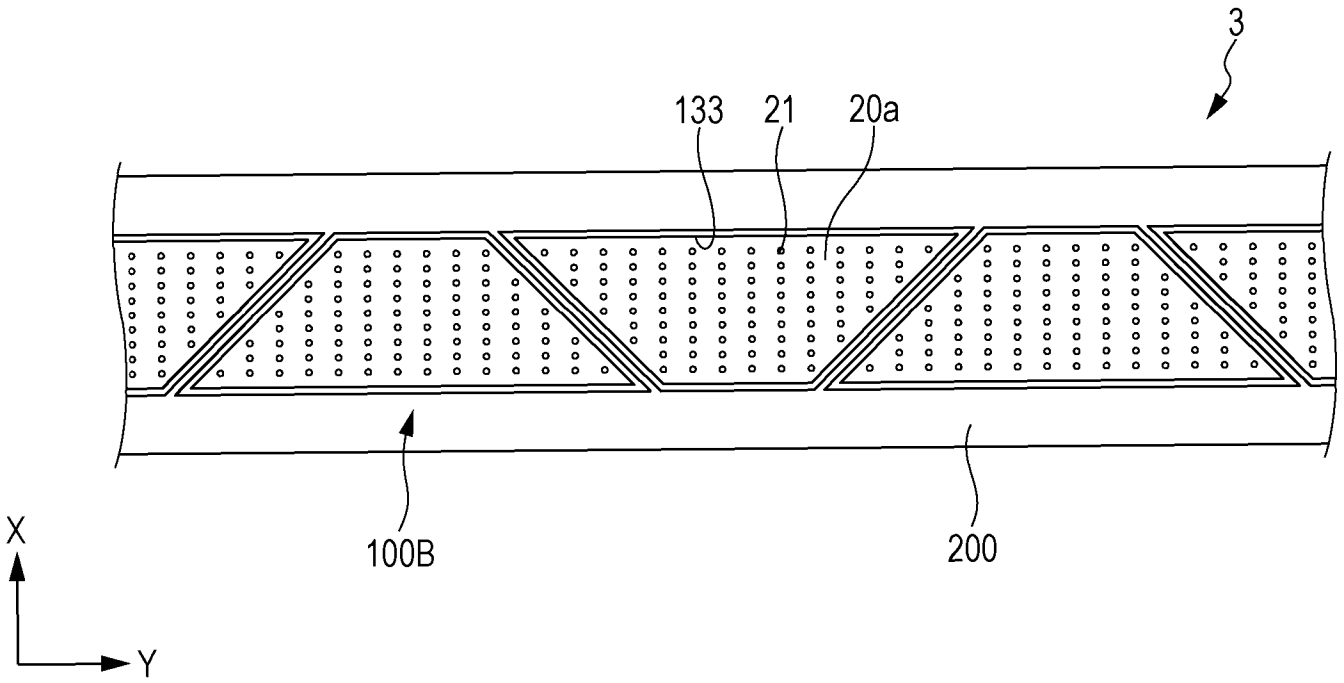
FIG. 11 is a plan view of a head unit according to another embodiment of the invention.

Furthermore, in the above-described Embodiment 1, the fourth direction Xa which is the direction in which the nozzle openings 21 of the head main body 110 are provided in parallel is disposed to be a direction which is inclined with respect to the second direction Y perpendicular to the first direction X which is the transporting direction. However, the fourth direction Xa in which the nozzle openings 21 are provided in parallel may be the same direction as the first direction X which is the transporting direction, and the fourth direction Xa in which the nozzle openings 21 are provided in parallel may be the same direction as the second direction Y. Furthermore, the nozzle openings 21 are not limited to the openings provided in a row form, and the nozzle openings 21 may be disposed in a matrix form. Furthermore, in the above-described Embodiment 1, when viewed in a planar view from the third direction Z perpendicular to the liquid ejecting surface 20*a*, the shape of the holder 120 is a substantial parallelogram, but the shape is not limited thereto, and may be rectangular, trapezoidal, or polygonal. Here, an example is illustrated in FIG. 11. In addition, FIG. 11 is a plan view from the liquid ejecting surface side of the ink jet type recording head unit which is an example of the liquid ejecting head unit according to another embodiment of the invention.

As illustrated in FIG. 11, an ink jet type recording head 100B has a trapezoidal shape when viewed from the liquid ejecting surface 20*a* side in a planar view. In addition, the plurality of ink jet type recording heads 100B is provided in parallel in the second direction Y and fixed to the head fixing substrate 200, and every other ink jet type recording head 100B provided in parallel in the second direction Y is disposed to be reversed by 180 degrees in the in-plane directions of the liquid ejecting surface 20*a*.

Even in the configuration, similarly to the above-described embodiment, among the first intersection point which is at the outer side of the first curved part of the abutting area and which is on the virtual line which extends each of the two straight line parts that is connected to the first curved part, and the second intersection point which is at the outer side of the second curved part of the abutting area and which is on the virtual line which extends each of the two straight line parts that is connected to the second curved part, the reference holes are provided at a position which is nearer to the first intersection point than the second intersection point. Accordingly, the effect similar to the description above is achieved.

Furthermore, in the above-described Embodiment 1, the so-called line type recording apparatus is described as an example of the ink jet type recording apparatus 1 in which the head unit 3 is fixed to the apparatus main body 2 and the printing is performed only by transporting the recording sheet S, but the invention is not particularly limited thereto. It is possible to employ the invention even in a so-called serial type recording apparatus in which the head unit 3 is mounted on a carriage which moves in the second direction Y, for example, the direction which intersects with the first direction X that is the transporting direction of the recording sheet S and the printing is performed while the head unit 3 moves in the direction which intersects with the transporting direction.

In addition, in the above-described Embodiment 1, the pressure generation section which causes a pressure change in the pressure generation chamber 12 is described by using the piezoelectric actuator 300 stacked in the third direction Z. However, the piezoelectric actuator 300, for example, may be a thin film type formed by a film forming method or a lithography method, a thick film type formed by a method, such as sticking a green sheet, or the like. In addition, the piezoelectric actuator 300 can be alternately stacked with a piezoelectric material and an electrode forming material, and use a longitudinal vibration type which extends and contracts in an axial direction. In addition, as the pressure generation section, it is possible to use a section which disposes a heating element inside the pressure generation chamber and ejects the liquid droplets from the nozzle openings 21 by bubbles generated by heating the heating element, a so-called an electrostatic actuator which generates static electricity between the diaphragm and the electrode and ejects the liquid droplets from the nozzle openings 21 by deforming the diaphragm according to an electrostatic force, or the like.

In addition, in the above-described Embodiment 1, the transporting direction of the recording sheet S is referred to as the first direction X, the direction perpendicular to the first direction X in the in-plane directions in which the nozzle openings of the head unit 3 is opened is referred to as the second direction Y, and the direction perpendicular to the first direction X and the second direction Y is referred to as the third direction Z. The fourth direction Xa which is the direction in which the nozzle openings 21 are provided in parallel is inclined with respect to the first direction X, and the fifth direction Ya which is a relative movement direction of a wiper blade 160 with respect to the cover 130 matches with the second direction Y, but the invention is not limited thereto. For example, with respect to the fifth direction Ya which is the relative movement direction of a wiper blade 160 with respect to the cover 130, the fourth direction Xa in which the nozzle openings 21 are provided in parallel, and the direction perpendicular to the fourth direction Xa and the fifth direction Ya may be referred to as the third direction Z. In the in-plane directions in which the nozzle openings of the head unit 3 are opened, the direction which intersects with the fourth direction Xa and the fifth direction Ya may be referred to as the first direction X which is the transporting direction of the recording sheet S. The second direction Y may match with the fifth direction Ya, and the direction perpendicular to the fifth direction Ya in the in-plane directions in which the nozzle openings of the head unit 3 are opened may not match with the first direction X. Even the liquid ejecting apparatus and the liquid ejecting head unit can employ the invention. In other words, in a part in which a group of nozzle openings in the wiper is wiped, a wiping defect does not occur and durability of the wiper is excellent since there is no interference with the edge portion of any of the fixing boards.

What is claimed is:

1. A liquid ejecting head, comprising:

a fixing board which can abut against a rib of a cap with respect to a liquid ejecting surface at a ring-shaped abutting area;

a driving element for ejecting liquid via nozzle openings provided on the liquid ejecting surface, wherein the cap relatively moves with respect to the liquid ejecting surface, wherein the fixing board is in a shape having an acute angle portion and an obtuse angle portion, wherein, when viewed from a direction perpendicular to the fixing board, the abutting area includes a pair of first curved parts corresponding to the acute angle portion, a pair of second curved parts corresponding to the obtuse angle portion, a plurality of straight line parts which can connect two curved parts among the pair of first curved parts and the pair of second curved parts, and wherein, at an outer side of the abutting area in the liquid ejecting surface, among a first intersection point on virtual lines which extend each of the two straight line parts that is connected to the first curved part and a second intersection point on virtual lines which extend each of the two straight line parts that is connected to the second curved part, the fixing board has reference holes at a position which is nearer to the first intersection point than the second intersection point.

2. The liquid ejecting head according to claim 1, wherein the first curved part has a less absolute value of a curvature than the second curved part.

3. A liquid ejecting head unit, comprising:

the liquid ejecting head according to claim 2; and a fixing substrate which maintains the plurality of liquid ejecting heads provided in parallel in a reference direction, in the in-plane directions of the liquid ejecting surface.

4. A liquid ejecting apparatus, comprising:

the liquid ejecting head according to claim 2.

5. A liquid ejecting apparatus, comprising:

the liquid ejecting head unit according to claim 3.

6. The liquid ejecting head according to claim 1, wherein the fixing board has a plurality of abutting areas, and wherein the reference holes are provided between the plurality of abutting areas.

7. A liquid ejecting head unit, comprising:

the liquid ejecting head according to claim 3; and a fixing substrate which maintains the plurality of liquid ejecting heads provided in parallel in a reference direction, in the in-plane directions of the liquid ejecting surface.

8. A liquid ejecting apparatus, comprising:

the liquid ejecting head according to claim 6.

9. The liquid ejecting head according to claim 1, wherein the reference holes are provided nearer to the acute angle portion of the fixing board than the obtuse angle portion of the fixing board.

10. A liquid ejecting head unit, comprising:

the liquid ejecting head according to claim 9; and a fixing substrate which maintains the plurality of liquid ejecting heads provided in parallel in a reference direction, in the in-plane directions of the liquid ejecting surface.

11. A liquid ejecting apparatus, comprising:

the liquid ejecting head according to claim 9.

12. The liquid ejecting head according to claim 1, wherein, in a direction perpendicular to a movement direction when a wiper relatively moves with respect to the fixing board among in-plane directions of the fixing board, the reference holes are disposed at the outer side of an area provided with the plurality of nozzle openings.

13. A liquid ejecting head unit, comprising:

the liquid ejecting head according to claim 12; and a fixing substrate which maintains the plurality of liquid ejecting heads provided in parallel in a reference direction, in the in-plane directions of the liquid ejecting surface.

14. A liquid ejecting apparatus, comprising:

the liquid ejecting head according to claim 12.

15. The liquid ejecting head according to claim 1, wherein, in a direction perpendicular to the movement direction when the wiper relatively moves with respect to the fixing board among the in-plane directions of the fixing board, the reference holes are positioned at the outer side of the abutting area.

16. A liquid ejecting head unit, comprising:

the liquid ejecting head according to claim 15; and a fixing substrate which maintains the plurality of liquid ejecting heads provided in parallel in a reference direction, in the in-plane directions of the liquid ejecting surface.

17. A liquid ejecting apparatus, comprising:

the liquid ejecting head according to claim 15.

18. A liquid ejecting head unit, comprising:

the liquid ejecting head according to claim 1; and a fixing substrate which maintains the plurality of liquid ejecting heads provided in parallel in a reference direction, in the in-plane directions of the liquid ejecting surface.

19. A liquid ejecting apparatus, comprising:

the liquid ejecting head unit according to claim 18.

20. A liquid ejecting apparatus, comprising:

the liquid ejecting head according to claim 1.

* * * * *